United States Patent [19]

West

[11] Patent Number: 4,757,288

[45] Date of Patent: Jul. 12, 1988

[54] CERAMIC TEM BANDSTOP FILTERS

[75] Inventor: James B. West, Cedar Rapids, Iowa

[73] Assignee: Rockwell International Corporation, El Segundo, Calif.

[21] Appl. No.: 19,400

[22] Filed: Feb. 25, 1987

[51] Int. Cl.[4] ..... H01P 1/205; H01P 7/04

[52] U.S. Cl. ..... 333/206; 333/202; 333/204; 333/222

[58] Field of Search ..... 333/202, 203, 204, 206, 333/207, 219, 222-226, 235

[56] References Cited

U.S. PATENT DOCUMENTS

| | | | |
|---|---|---|---|
| 4,179,673 | 12/1979 | Nishikawa et al. | 333/204 |
| 4,268,809 | 5/1981 | Makimoto et al. | 333/202 |
| 4,410,868 | 10/1983 | Meguro et al. | 333/207 X |
| 4,431,977 | 2/1984 | Sokola et al. | 333/222 |
| 4,464,640 | 8/1984 | Nishikawa et al. | 333/202 |
| 4,523,162 | 6/1985 | Johnson | 333/202 |

FOREIGN PATENT DOCUMENTS

| | | | |
|---|---|---|---|
| 0001301 | 1/1983 | Japan | 333/202 |
| 0254802 | 12/1985 | Japan | 333/202 |

OTHER PUBLICATIONS

"Comb-Line Bandpass Filters of Narrow or Moderate Bandwidth" by George L. Matthaei, Aug. 1963, *Microwave Journal*, pp. 82-91.

"Analysis and Composition of a New Microwave Filter Configuration with Inhomogeneous Dielectric Medium" by A. Fukasawa, *IEEE Trans. on Microwave Theory and Techniques*, vol. MTT-30, No. 9, Sep. 1982, pp. 1367-1375.

"Ceramic-Filled Resonator Cuts Costs of Radio-Telephone Filters" by T. Uwano, Jul. 14, 1983, *Electronics*, vol. 56:129-131.

*Microwave Filters Impedance Matching Networks and Coupling Structures* by G. L. Matthaei et al, McGraw Hill Book Co., NY, NY, 1964, Sections 8.13 and 8.14.

*Microwave Filters Impedance Matching Networks and Coupling Structures* by G. L. Matthaei et al, McGraw Hill Book Co., NY, NY, 1964, Sections 12.01-12.07.

*Primary Examiner*—Marvin L. Nussbaum

*Attorney, Agent, or Firm*—Gregory G. Williams; M. Lee Murrah; H. Fredrick Hamann

[57] ABSTRACT

A ceramic TEM resonator bandstop filter is disclosed wherein the direct inter-resonator coupling is retarded by a plurality of shorting holes which are positioned between the resonators and extend from the top surface to the bottom surface of said ceramic filters. Furthermore, there is disclosed a transverse electrical connector which electrically connects the shorting holes with the opposite sides of the typical metalization found on ceramic TEM resonator filters. Furthermore, there is disclosed a method of making a capacitor for each resonator with the bottom capacitor pad being formed directly upon the top surface of the ceramic of the filter while the top capacitor pad is formed upon the top surface of a circuit board which is placed above the top surface of the filter.

4 Claims, 2 Drawing Sheets

CERAMIC TEM BANDSTOP FILTERS

BACKGROUND OF THE INVENTION

Cross-reference to Related Applications

This application relates to the subject matter of a co-pending application by the same inventor entitled "Ceramic TEM Resonator Bandpass Filters with Varactor Tuning", filed on even date herewith and assigned to the same assignee, the serial number of which is 07/019,399, and to a co-pending application by James B. West and James C. Cozzie, entitled "Launcher-less and Lumped Capacitor-less Ceramic Comb-line Filters", filed on even date herewith and assigned to the same assignee, the serial number of which is 07/019,398, and the subject matter of both of which applications is incorporated herein by this reference.

FIELD OF THE INVENTION

The present invention generally relates to microwave RF filters, and more particularly, is concerned with ceramic TEM resonator bandstop filters, and even more particularly, relates to monolithic ceramic TEM resonator bandstop filters, without full-width inter-resonator coupling barriers therein.

In recent years, there has been a significant desire among microwave RF engineers to reduce the overall size and circuit board attachment surface area of bandstop filters. These new smaller filters could find many uses throughout the microwave RF industry, especially where space constraints exist and it is desirable to reject a certain predetermined narrow band of frequencies while allowing other frequencies to pass with a very small degree of signal strength loss.

One method of bandstop filter construction which has been used to meet some of the the needs of microwave RF engineers is described and illustrated in the renowned treatise, "Microwave Filters, Impedance Matching Networks, and Coupling Structures" by George L. Matthaei, Leo Young, and E. M. T. Jones, which was published by McGraw Hill Book Company of New York, N.Y. in 1964. Sections 12.1 through 12.7 of this work are herein incorporated by this reference. The air dielectric filter as disclosed therein has been used to perform the bandstop filtering function in the past. The design disclosed therein teaches the elimination of inter-resonator direct coupling by the physical separation of the resonators.

One method of preventing the direct inter-resonator coupling without utilizing the physical separation technique taught in Matthaei, Young and Jones is disclosed and illustrated in U.S. Pat. No. 4,268,809 to Mitsuo Makimoto which is incorporated herein by this reference. Makimoto utilizes a shielding sheet member interposed within the air dielectric between the resonators of a bandpass filter. The shielding sheet member is shown as extending completely across the filter and literally forming a barrier between all but the very top portions of the resonators.

While these systems, or variations of them, have been used extensively for filtering microwave RF signals, they do have numerous serious drawbacks. One major problem with the classic bandstop filter having an air dielectric and utilizing physical separation to preclude direct inter-resonator coupling is that the overall size and surface area occupied by such a filter on a circuit board is often very undesirable. With the current trend toward miniaturization, ceramic materials are beginning to replace the traditional air dielectrics in such filters. While the use of full-width shielding sheet members for preventing direct inter-resonator coupling is undesirable in filters utilizing a ceramic dielectric because the mechanical and structural material properties of such dielectrics make the placement of such shielding plate members difficult to accomplish in miniaturized filters.

Consequently, a need exists for improvement in bandstop microwave RF filters which will result in an overall size and attachment surface area reduction while concomitantly allowing for easy preclusion of direct inter-resonator coupling.

SUMMARY OF THE INVENTION

It is an object of the present invention to reduce the overall size and surface area of microwave RF bandstop filters.

It is a feature of the present invention to utilize a ceramic dielectric disposed between and interconnecting the resonators of a TEM resonator bandstop filter.

It is an advantage of the present invention to eliminate the air dielectric separating the resonators of a TEM resonator bandstop filter.

It is an object of the present invention to provide an overall reduction in the inter-resonator distance in TEM resonator bandstop filters.

It is a feature of the present invention to include at least one plated-through bore hole disposed between the resonators and in electrical connection with the exterior metalization typically found in TEM resonator bandstop filters.

It is an advantage of the present invention to eliminate the need for a shielding sheet member disposed between the resonators thereby increasing the ease of the manufacture and construction of ceramic TEM bandstop filters.

The present invention provides a ceramic TEM resonator bandstop filter designed to satisfy the aforementioned needs, produce the previously-propounded objects, include the above-described features, and achieve the disclosed advantages. A microwave RF signal is filtered by a "shielding sheet memberless" microwave RF ceramic monolithic bandstop filter in the sense that the shielding sheet members typically utilized to prevent direct inter-resonator coupling in air have been eliminated. Instead, the direct inter-resonator coupling is precluded by implementing a plated-through bore hole disposed between each of the resonators and extending from the top of the filter to the bottom of the filter and further being electrically connected at the top of the filter to the filter side metalization. Also, the ease of manufacturing and constructing ceramic TEM bandstop filters is enhanced by this invention.

Accordingly, the present invention relates to an apparatus and method for filtering microwave RF signals which include a TEM resonator bandstop filter having a ceramic dielectric therein and further having at least one plated-through bore hole disposed between the filter resonators and further in electrical connection with the filter side metalization.

BRIEF DESCRIPTION OF THE DRAWINGS

The invention will be best understood by a reading of the description in conjunction with the drawings, in which.

DETAILED DESCRIPTION

Figure 1:
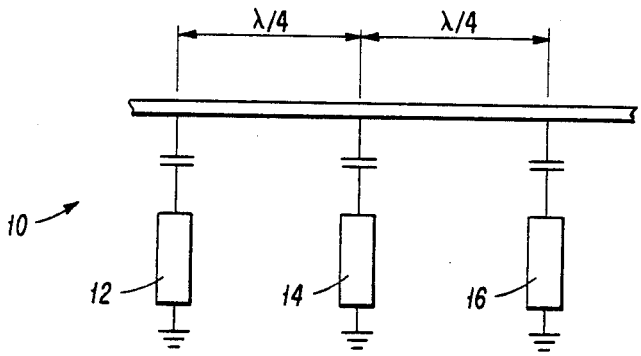
FIG. 1 is a schematic representation of prior art bandstop filters on printed circuit boards consisting of capacitively coupled shorted transmission lines together at one-quarter wavelength intervals.

Referring now to the drawings, and more particularly to FIG. 1, there is shown a prior art bandstop filter generally designated 10 comprising a first, second and third capacitively coupled transmission lines 12, 14 and 16, respectively. The transmission lines consist of stubs printed on a circuit board and shorted to a common reference voltage. At the lower microwave frequencies, and especially UHF frequencies, the physical dimensions of such filters become excessively large and require substantial board area. Quarter wave lines may be slightly foreshortened, as is known in the art.

Figure 2:
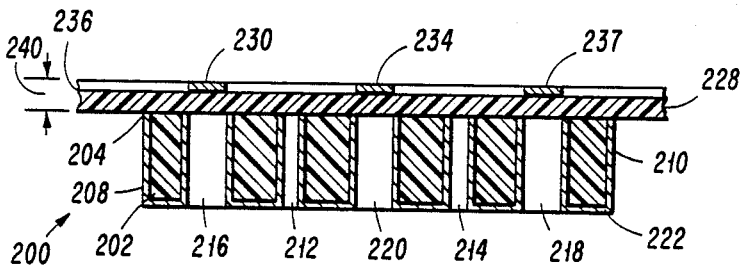
FIG. 2 is a cross-sectional view of a ceramic TEM resonator bandstop filter of the present invention utilizing a ceramic block with resonator bore holes therein and plated-through bore holes disposed between each of the resonator bore holes, together with a microstrip board having coupling capacitors associated with each resonator integrated therein.

A solution to the excessively-large dimensions of microwave frequency bandstop filters and the associated circuit board surface area requirement is shown in FIG. 2. More specifically, there is shown a ceramic TEM resonator bandstop filter generally designated 200, taken on line 2—2 of FIG. 3, and comprising a ceramic block 202 having a top side 204, a bottom side 206, a first end 208, and a second end 210. Ceramic block 202 is shown having a first TEM resonator bore hole 216, a second TEM resonator bore hole 218, and a central TEM resonator bore hole 220. The two preferred ceramic materials for block 202 are barium tetratitanate ($BaTi_4O_9$) and zirconium tin titanate [(Zr, Sn)($TiO_2$)]. Bore holes 216, 218 and 220 extend through block 202 from top side 204 to bottom side 206, and are preferably created by drilling holes through the ceramic block 202. A metallic coating 222 covers all surfaces of the ceramic block 202 including the sides of resonator bore holes 216, 218 and 220, and excluding only portions of top side 204. The metallic coating 222 can be any electrically conductive material, with a copper or silver thick film followed by copper electroplate being preferred. Block 202 is further shown having a first shorting hole 212 and a second shorting hole 214 which extend through block 202 from top side 204 to bottom side 206, which are also preferably created by drilling holes through the ceramic block 202. The sides of shorting holes 212 and 214 are also covered by metallic coating 222 in a manner similar to resonator bore holes 216, 218 and 220. Shorting hole 212 is shown disposed between first resonator hole 216 and central resonator hole 220 while shorting hole 214 is shown disposed between central resonator hole 220 and second resonator hole 218. Transverse electrical connectors 224 and 226 are disposed on top side 204 and are in contact with shorting holes 212 and 214, respectively. The shorting holes 212 and 214 are included to inhibit the inter-resonator coupling between first resonator 216, central resonator 220 and second resonator 218. The shorting holes 212 and 214 are in electrical connection with the metallic coating 222. It is expected that more than one shorting hole between each resonator may be used. A microstrip board 228 having a first integrated coupling capacitor pad 230, a second integrated coupling capacitor pad 232 and a central integrated coupling capacitor pad 234 disposed on its top surface 236 while its bottom surface 238 is in contact with top side 204 of block 202. The ground plane of the microstrip resonator is removed in the vicinity of the capacitor area. Capacitor pads 230, 232 and 234 are part of the coupling capacitors typically associated with resonator holes 216, 218 and 220, respectively. The size, shape and length of resonator holes 216, 220 and 222 and coupling capacitor pads 230, 232 and 234 are variable, depending upon the desired characteristics of the filter 200. The capacitance provided by the capacitors form with capacitor pads 230, 232 and 234 can be varied also be varying the thickness 240 between the top surface 236 and bottom surface 238 of microstrip board 228. Varying the microstrip board 228 thickness creates a variable distance between capacitor pads 230, 232 and 234 and the top ends of resonators 216, 218 and 220 at top surface 204 of block 202. Stripline circuitry could also be used instead of microstrip.

Figure 3:
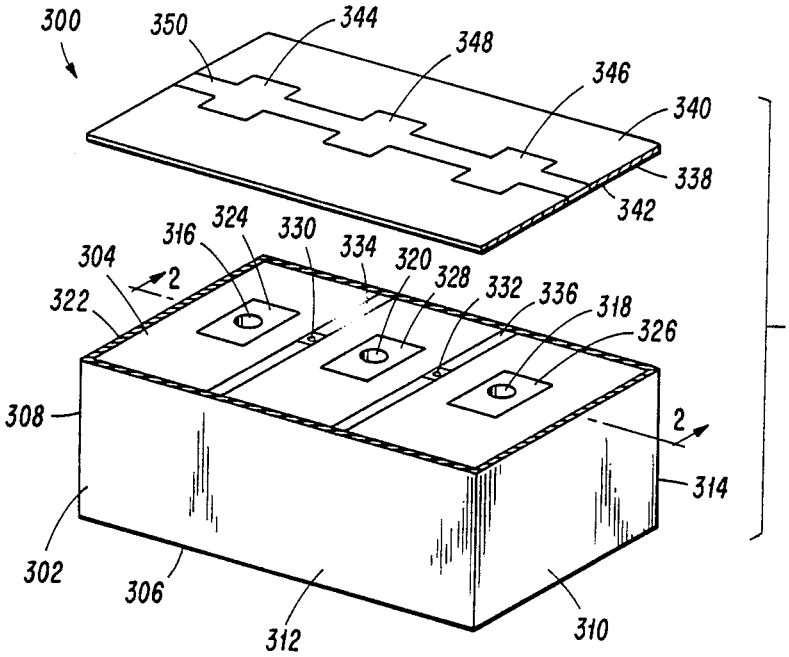
FIG. 3 is an exploded perspective view of the ceramic TEM resonator bandstop filter of the present invention having a plurality of plated-through bore holes disposed between each resonator.

The invention can be more clearly understood by referring now to FIG. 3, which shows an exploded perspective view of the ceramic TEM resonator bandstop filter of FIG. 2, generally designated 300, comprising a ceramic block 302 having a top side 304, a bottom side 306, a first end 308, a second 310, a first side 312, and a second side 314. Ceramic block 302 has a first TEM resonator hole 316, a second TEM resonator hole 318, and a central TEM resonator hole 320. Holes 316, 318 and 320 extend through block 302 from top side 304 to bottom side 306, and are preferably created by drilling holes through the ceramic block 302. A metallic coating 322 covers all surfaces of ceramic block 302, including the sides of holes 316, 318 and 320 and excluding only portions of top side 304. Top surface 304 further has a first capacitor pad 324, a second capacitor pad 326, and a central capacitor pad 328. These capacitor pads are in part to provide the capacitance typically associated with each resonator in a classic TEM resonator bandstop filter. Capacitor pads 324, 326 and 328 are preferably composed of the same material as metallic coating 322 and are disposed around and in electrical connection with the plating 322 on the sides of and extending through resonator holes 316, 318 and 320, respectively. Block 302 is further shown having a first plated-through shorting hole 330 and a second plated-through shorting hole 332 Plated-through shorting holes 330 and 332 extend from top surface 304 through block 302 and terminate at bottom surface 306, and are plated with a metal coating 322, thereby being in electrical connection with resonators 316, 318 and 320. The first plated-through shorting hole 330 is disposed between first TEM resonator 316 and central TEM resonator 320, while the second shorting hole 332 is disposed between central TEM resonator 320 and second TEM resonator 318. A first transverse electrical connector 334 connects the first shorting hole 330 with the metallic coating 322 at the top surface 304 of block 302 along sides 312 and 314. A second transverse electrical connector 336 between the second shorting hole 332 is disposed between central TEM resonator 320 and second TEM resonator 318 in a manner similar to connector 334.

Filter 300 further comprises a circuit board 338 having a top planar surface 340 and a bottom planar surface 342. Board 338 as is shown in an exploded view in FIG. 3 is capable of engaging, along its bottom surface 342, the top surface 304 of block 302. A first top capacitor pad 344, a second top capacitor pad 346 and a central top capacitor pad 348 are shown integrated on top surface 340 of board 338 with an electrical trace 350 extending therebetween. Electrical trace 350 forms the quarter wave interconnecting lines which are typically found in TEM resonator bandstop filters. Top capacitor pads 344, 346 and 348 together with capacitor pads 324, 326 and 328, respectively, form the capacitors typically associated with resonators 316, 318 and 320 respectively of a TEM resonator.

Figure 4:
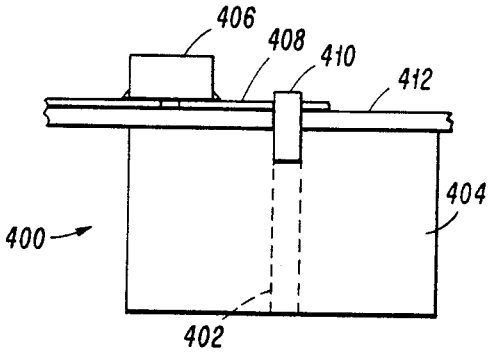
FIG. 4 is a cross-sectional view of an alternative embodiment of the ceramic TEM resonator bandstop filter of the present invention which utilizes a chip capacitor disposed on top of the microstrip board.

In certain applications, it is desirable to provide a large capacitance when designing a certain TEM resonator bandstop filter. An alternative embodiment of the present invention is schematically illustrated, in part, in FIG. 4 where the filter generally designated 400, which will typically have several TEM resonators 402 in a ceramic block 404, similar to those illustrated in FIGS. 2 and 3. The TEM resonator 402 is in electrical connection with a chip capacitor 406 by soldered circuit trace 408 with connecting pin 410 therebetween. This implementation allows for a wider range of capacitors to be utilized. These capacitors are typically associated with a TEM resonator and their capacitance is variable depending uon the desired characteristics of the overall filter 400.

Figure 5A:
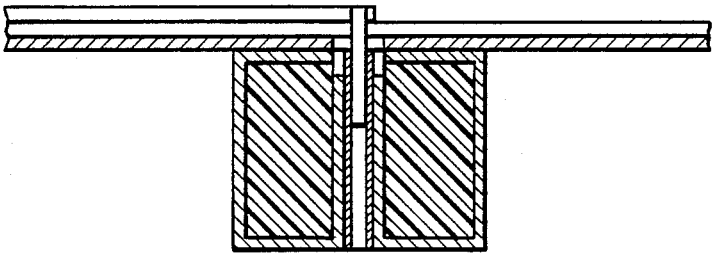
FIGS. 5*a* and 5*b* show an alternative embodiment of the invention.
Figure 5B:
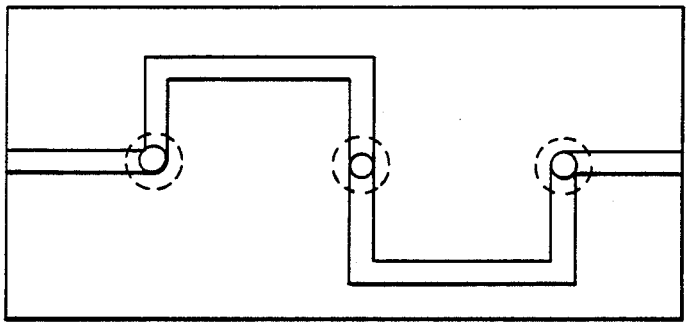

An alternative embodiment of this invention is shown in FIG. 5A. The ceramic resonator structure, generally designated 500, is plated on all surfaces, including the top and the hole interiors, by a thin conductive coating 502. An unplated portion 504 is then formed by selectively removing the plating 502 from the holes as shown. The coupling capacitance, typically associated with such filters, is formed by inserting a probe into an insulating sleeve cylinder 508, which is preferably rexalite. This cylinder 508 is positioned inside the resonator hole as shown. A small area of a ground plane 510 of the microstrip board 512 is removed in the vicinity of the probe. This vicinity of ground plane removal is better understood when viewed in connection with FIG. 5B. Where the vicinities of ground plane removal are designated by circular dotted lines concentric about the resonator holes.

This alternative embodiment is an improved design for higher frequency applications because is minimized the interaction between the ceramic resonators 520, 522 and 524 and the circuit board traces 526. The top metallization on the ceramic forms a shunt capacitance on the resonator that is consistent with the current machining technology. This top metallization also forms a shielding between the EM field in the ceramic structure and the double sided circuit board. Since only a very small portion of the ground plane of the microstrip circuit board is removed, the microstrip board has well-defined properties. 4.

It is thought that the monolithic ceramic TEM resonator bandstop filters of the present invention, and many of their attendent advantages, will be understood from the foregoing description, and it will be apparent that various changes may be made in the form, construction, and arrangement of the parts thereof without departing from the spirit and scope of the invention, or sacrificing all of their material advantages, the forms hereinbefore described being merely preferred or exemplary embodiments thereof.

I claim:

1. A ceramic dielectric microwave RF filter comprising:

a. a single dielectric block having a top surface, a bottom surface, a first end, a second end, a front side, and a back side;

b. said dielectric block further having a plurality of resonator holes, for forming TEM resonators, spatially disposed at a predetermined distance from another and extending from said top surface to said bottom surface;

c. said dielectric block further having a conductive material coating formed upon all surfaces including sides of said plurality of resonator holes and excepting only the top portion of said plurality of resonator holes;

d. a plurality of capacitor probes extending into said plurality of resonator holes;

e. a plurality of insulator sleeves disposed within said plurality of resonator holes for receiving and separating said capacitor probes with said plurality of resonator holes; and f. a microstrip board having a ground plane therein and further having a plurality of regions therein wherein the ground plane has been removed, and said plurality of regions being disposed above said plurality of resonator holes.

2. A ceramic dielectric microwave RF filter comprising:

a. a single dielectric block having a top surface, a bottom surface, a first end, a second end, a front side, and a back side;

b. said dielectric block further having a plurality of resonator holes, for forming TEM resonators, spatially disposed at a predetermined distance from another and extending from said top surface to said bottom surface;

c. said dielectric block further having a continuous conductive material coating formed upon all surfaces including the sides of said plurality of resonator holes and excepting only said top surface;

d. a first plurality of capacitor pads each positioned around and in electrical contact with one of said plurality of resonator holes;

e. a plurality of through said dielectric block and extending from said top surface to said bottom surface shorting holes, for inhibiting direct interresonator coupling, spatially disposed at a predetermined distance from another, and further being disposed between said plurality of said resonator holes.

3. A filter of claim 2 further comprising a plurality of transverse electrical connectors, each positioned between said plurality of resonator holes and extending from said front side to said back side.

4. A filter of claim 3 further comprising:

a. a planar circuit board having a top surface and a bottom surface;

b. a second plurality of capacitor pads spatially disposcd on said top surface and each being disposed directly above one of said first plurality of capacitor pads, when said bottom surface of said circuit board is contacting said top surface of said block.

* * * * *